US008328384B2

(12) United States Patent
Wang

(10) Patent No.: US 8,328,384 B2
(45) Date of Patent: Dec. 11, 2012

(54) FLASHLIGHT MOUNT

(75) Inventor: Ching-Hsiang Wang, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 295 days.

(21) Appl. No.: 12/904,250

(22) Filed: Oct. 14, 2010

(65) Prior Publication Data

US 2012/0092880 A1 Apr. 19, 2012

(51) Int. Cl.
*F21L 4/00* (2006.01)

(52) U.S. Cl. ..... 362/191; 362/106; 362/190; 362/396; 362/421

(58) Field of Classification Search ..... 362/105, 362/106, 190, 191, 396, 421
See application file for complete search history.

(56) References Cited

U.S. PATENT DOCUMENTS 5,103,384 A * 4/1992 Drohan ..... 362/191
5,658,065 A * 8/1997 Jamieson ..... 362/106
6,749,166 B2 * 6/2004 Valentine et al. ..... 362/191
7,178,933 B1 * 2/2007 Chuang ..... 362/106
2005/0254238 A1 * 11/2005 Parker et al. ..... 362/191

* cited by examiner

*Primary Examiner* — Stephen F Husar
(74) *Attorney, Agent, or Firm* — Alan Kamrath; Kamrath IP Lawfirm, P.A.

(57) ABSTRACT

A flashlight mount includes a clamp-type positioning element and an elongate clamping element pivotally connected to an upper section of the clamp-type positioning element. To fasten a flashlight to the mount, an engaging section on a lateral side of the flashlight is inserted into a C-shaped groove on a lateral side of a fastening extension of the elongate clamping element. Once the engaging section is inserted in the C-shaped groove to the greatest extent possible, a limiting recess at one end of the flashlight is engaged with a projection at the corresponding end of the fastening extension to fix the flashlight in position to the elongate clamping element. Then, an object to be clamped is inserted into an insertion space extending laterally into the clamp-type positioning element, before a lower screw rod is rotated upward to secure the clamp-type positioning element to the object in a clamping manner.

3 Claims, 13 Drawing Sheets

FLASHLIGHT MOUNT

BACKGROUND OF THE INVENTION

1. Technical Field

The present invention relates to flashlight mounts and, more particularly, to a flashlight mount for fixing a flashlight rapidly and precisely in position and for being clamped to the edge of an object designed to provide lighting, so as to increase the flexibility of flashlight installation.

2. Description of Related Art

Nowadays, flashlights for illumination purposes can be conveniently adapted to various lighting situations by fastening the flashlights to clamping devices having the appropriate configurations. These clamping devices can be secured to objects intended for different uses to facilitate the installation and removal of flashlights when it is desired to use or not to use the flashlights. Furthermore, in order to enable flexible adjustment of the lighting angle of a flashlight fastened to such a clamping device, a certain section of the clamping device is typically provided with a component configured for angular adjustment, thus allowing users to adjust the lighting direction as needed.

BRIEF SUMMARY OF THE INVENTION

The present invention provides a flashlight mount of a novel configuration as an improvement over the conventional flashlight mounts that are designed to be clamped to the edges of various objects. The disclosed flashlight mount can fix a flashlight rapidly and precisely in position and be firmly clamped to the edge of an objet that is intended to provide lighting. With the present invention, the flexibility of flashlight installation is increased.

The first major object of the present invention is to provide a mount for clamping a flashlight, wherein the mount includes a clamp-type positioning element, a lower screw rod, an elongate clamping element, and a screw nut. The clamp-type positioning element has a lower section formed with an insertion space that extends laterally inward. The clamp-type positioning element further has a lower end which is adjacent to the insertion space and penetrated by a threaded hole in which the lower screw rod is screwed. The clamp-type positioning element also has an upper section formed as a receiving tube that has an inwardly extending ball-shaped space. The receiving tube has a threaded outer periphery and is circumferentially formed with a plurality of slots. The slots allow a ball-shaped connecting portion extending from a lower section of the elongate clamping element to be inserted into the receiving tube. The screw nut is mounted around the ball-shaped connecting portion and screwed on the outer periphery of the receiving tube such that the elongate clamping element is pivotally connected to the clamp-type positioning element. The elongate clamping element has an upper section formed as a fastening extension that extends horizontally. A C-shaped groove is concavely provided at one end of a lateral surface of the fastening extension while a projection is formed at the other end of the lateral surface where the C-shaped groove is located. To fasten a flashlight to the mount, an engaging section provided on a lateral side of the flashlight is inserted into the C-shaped groove formed on one side of the fastening extension. Once the engaging section is inserted in the C-shaped groove to the greatest extent possible, a limiting recess concavely provided at one end of the flashlight is engaged with the projection at the corresponding end of the fastening extension, thereby fixing the flashlight securely in position to the elongate clamping element. Following that, an object to be clamped is inserted into the insertion space extending laterally into the lower section of the clamp-type positioning element, and the lower screw rod is rotated upward to secure the clamp-type positioning element to the object in a clamping manner. Thus, not only can the flashlight be flexibly installed, but also the lighting angle of the flashlight can be adjusted as appropriate.

The second major object of the present invention to provide a mount for clamping a flashlight, wherein the mount includes an insertion-type positioning element, an elongate clamping element, and a screw nut. The insertion-type positioning element has a lower section extended with an insertion part. The insertion part has a surface formed with at least one resilient pressing portion. The insertion-type positioning element also has an upper section formed as a receiving tube that has an inwardly extending ball-shaped space. The receiving tube has a threaded outer periphery and is circumferentially formed with a plurality of slots. The slots allow a ball-shaped connecting portion extending from a lower section of the elongate clamping element to be inserted into the receiving tube. The screw nut is mounted around the ball-shaped connecting portion and screwed on the outer periphery of the receiving tube such that the elongate clamping element is pivotally connected to the insertion-type positioning element. The elongate clamping element has an upper section formed as a fastening extension that extends horizontally. A C-shaped groove is concavely provided at one end of a lateral surface of the fastening extension while a projection is formed at the other end of the lateral surface where the C-shaped groove is situated. To fasten a flashlight to the mount, an engaging section provided on a lateral side of the flashlight is inserted into the C-shaped groove formed on one side of the fastening extension. When the engaging section is inserted in the C-shaped groove to the greatest extent possible, a limiting recess concavely provided at one end of the flashlight is engaged with the projection at the corresponding end of the fastening extension, thereby fixing the flashlight securely in position to the elongate clamping element. Following that, the insertion part extending downward from the insertion-type positioning element is inserted into a predetermined space of an object to be connected with the mount. As a result, the at least one resilient pressing portion on one surface of the insertion part presses tightly against the wall of the predetermined space to secure the insertion-type positioning element to the object. Thus, not only is flexible installation of the flashlight achievable, but also the lighting angle of the flashlight can be adjusted as desired.

The third object of the present invention is to provide the foregoing mounts for clamping a flashlight, wherein the insertion part of the insertion-type positioning element has a lower end laterally extended with a hook. After the insertion part is inserted into the predetermined space of the object to be connected with the mount, the hook is engaged with a bottom portion of the object to fix the mount in position to the object.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
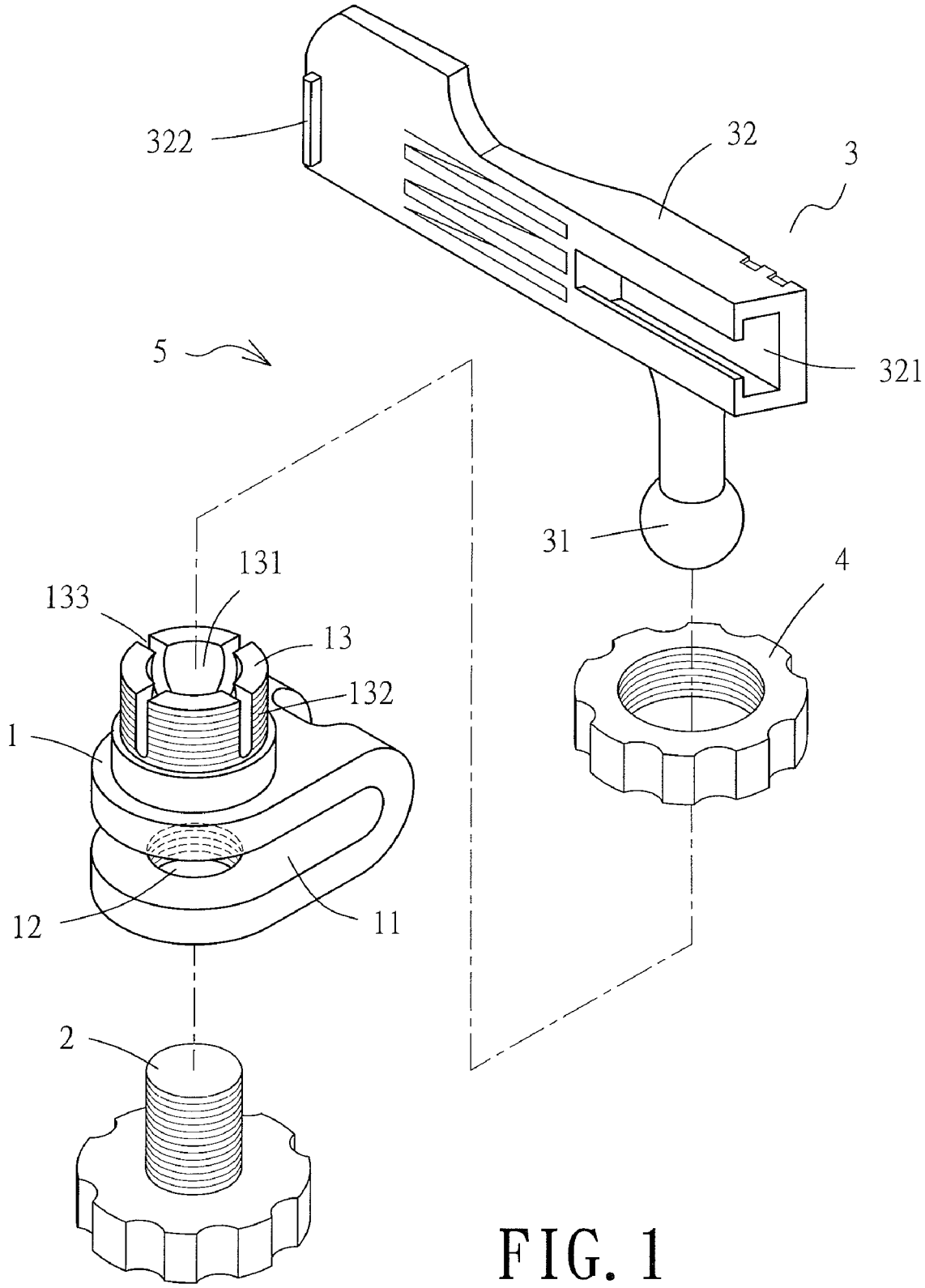
FIG. 1 is an exploded perspective view of a flashlight mount according to a first embodiment of the present invention.
Figure 2:
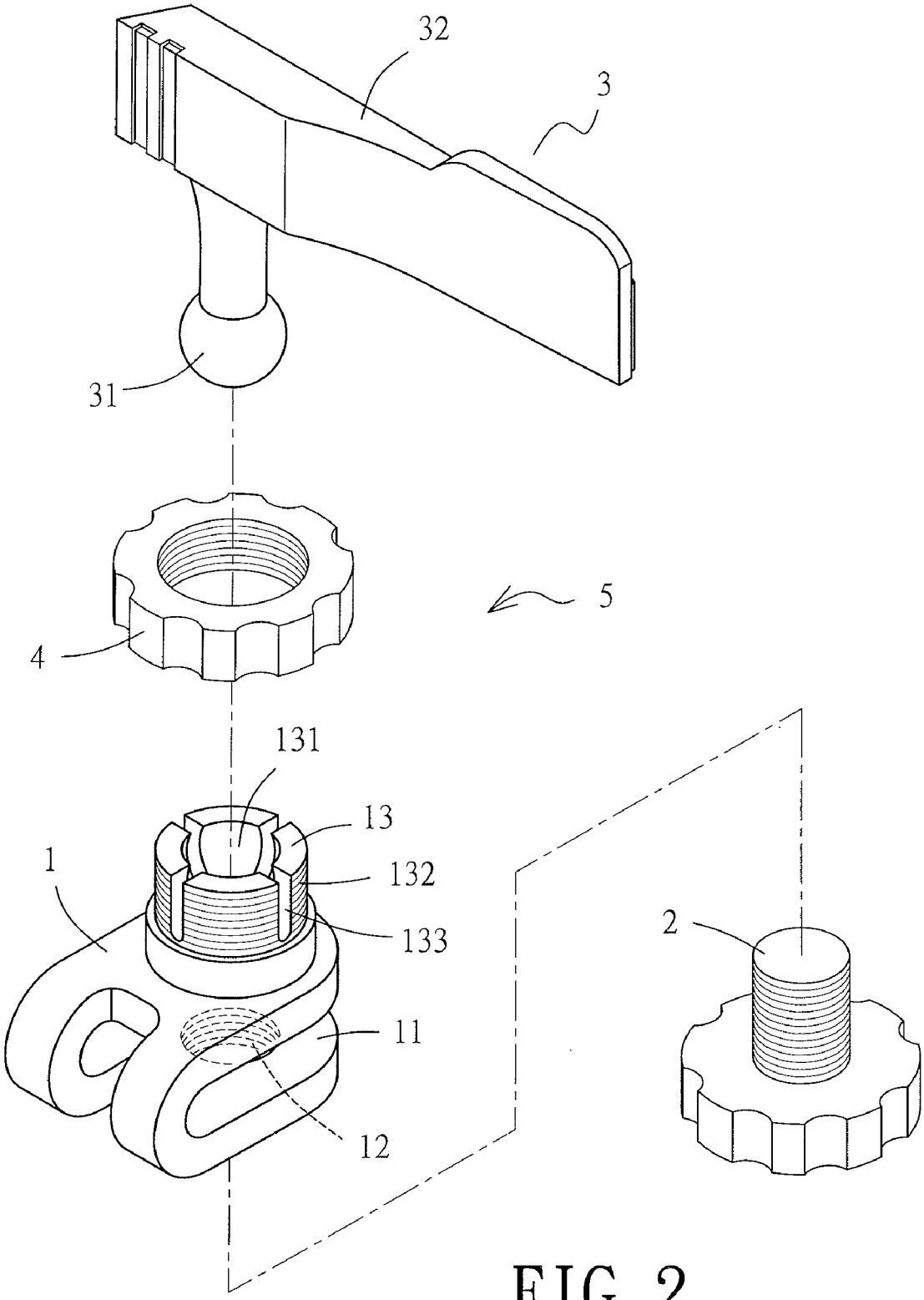
FIG. 2 is another exploded perspective view of the flashlight mount depicted in FIG. 1, when viewed from a different direction.

Referring to FIG. 1 and FIG. 2, a flashlight mount 5 according to a first embodiment of the present invention is configured to clamp a flashlight and includes a clamp-type positioning element 1, a lower screw rod 2, an elongate clamping element 3, and a screw nut 4.

The clamp-type positioning element 1 has a lower section formed with an insertion space 11. More specifically, the insertion space 11 extends laterally into the lower section of the clamp-type positioning element 1. The clamp-type positioning element 1 further has a lower end which is adjacent to the insertion space 11 and penetrated by a threaded hole 12 into which the lower screw rod 2 can be screwed. The upper section of the clamp-type positioning element 1 is formed as a receiving tube 13 having an inwardly extending ball-shaped space 131, as shown more clearly in FIG. 4. The outer periphery of the receiving tube 13 is formed with threads 132, and the receiving tube 13 is circumferentially provided with a plurality of slots 133 to facilitate tightening of the screw nut 4.

The elongate clamping element 3 has a lower section extended with a ball-shaped connecting portion 31 and an upper section formed as a fastening extension 32 that extends horizontally. A C-shaped groove 321 is concavely provided at one end of a lateral surface of the fastening extension 32, as shown in FIG. 1, while a projection 322 is formed at the other end of the lateral surface where the C-shaped groove 321 is provided.

Figure 3:
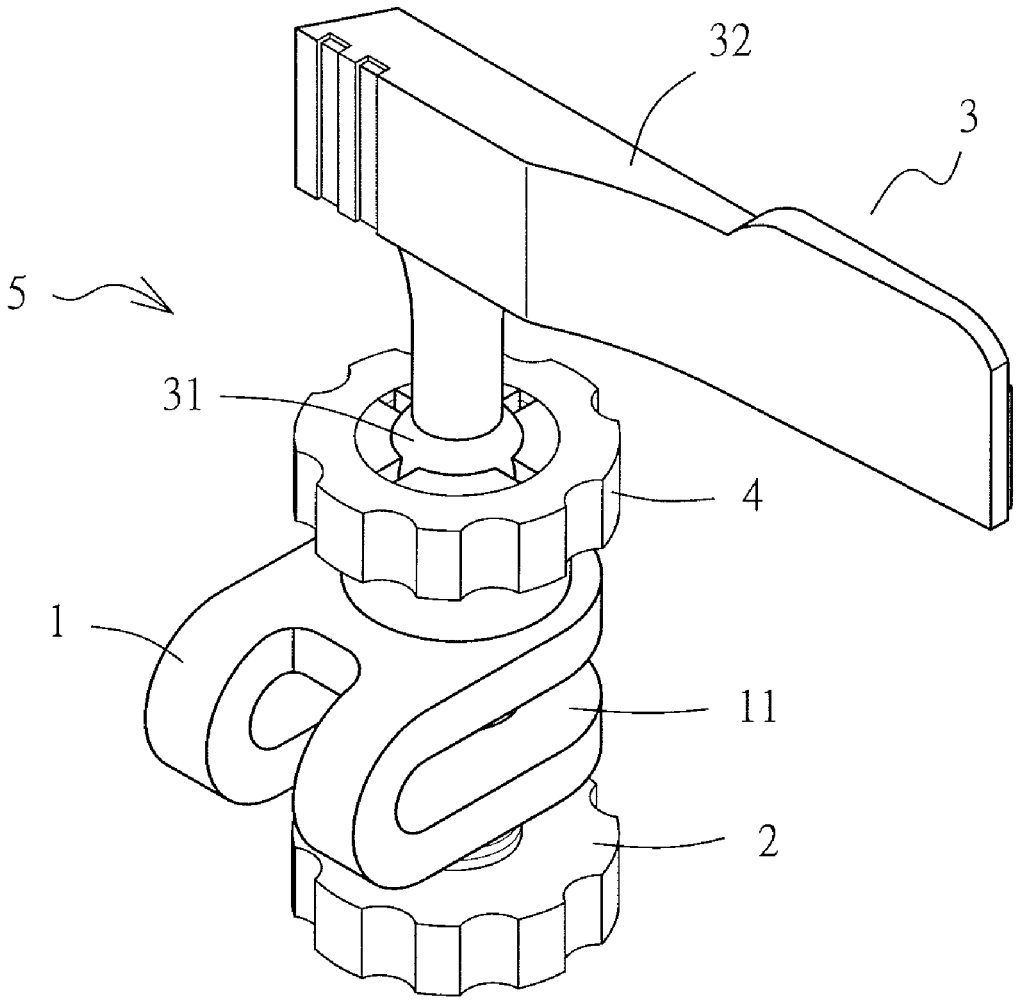
FIG. 3 is an assembled perspective view of the flashlight mount depicted in FIG. 1.
Figure 4:
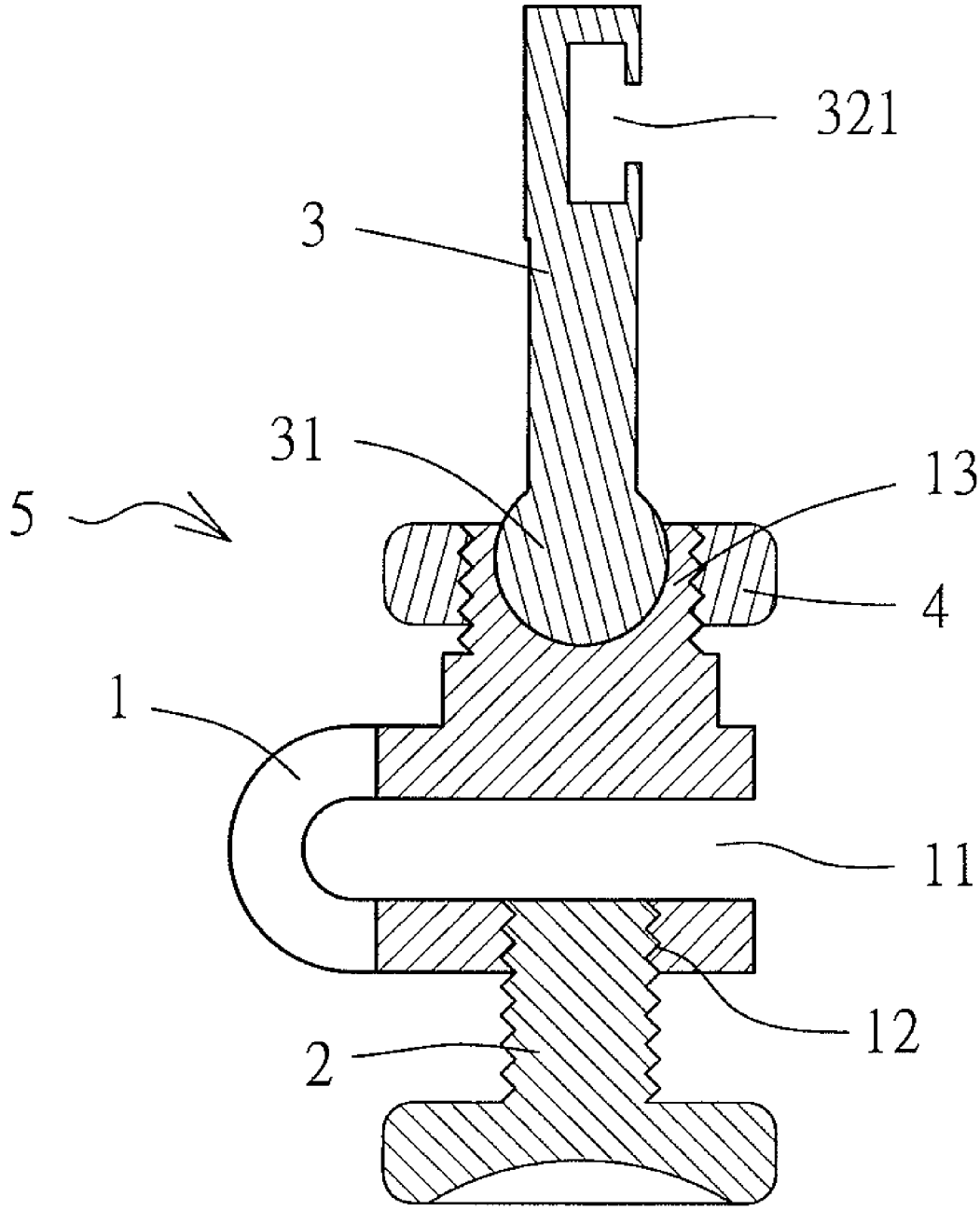
FIG. 4 is a front sectional view of the flashlight mount depicted in FIG. 1.

The clamp-type positioning element 1 and the elongate clamping element 3 are put together in the following manner. Referring to FIG. 3 and FIG. 4, the lower screw rod 2 is screwed into the threaded hole 12 at the lower end of the clamp-type positioning element 1. The screw nut 4 is mounted in advance around the ball-shaped connecting portion 31 in the lower section of the elongate clamping element 3. Then, the ball-shaped connecting portion 31 of the elongate clamping element 3 is inserted into the ball-shaped space 131 formed in the upper section of the clamp-type positioning element 1. Following that, the screw nut 4, which has been mounted around the ball-shaped connecting portion 31, is screwed on the outer periphery of the receiving tube 13 such that the elongate clamping element 3 is pivotally connected to the clamp-type positioning element 1. Thus, the assembly process of the mount 5 is completed.

Figure 5:
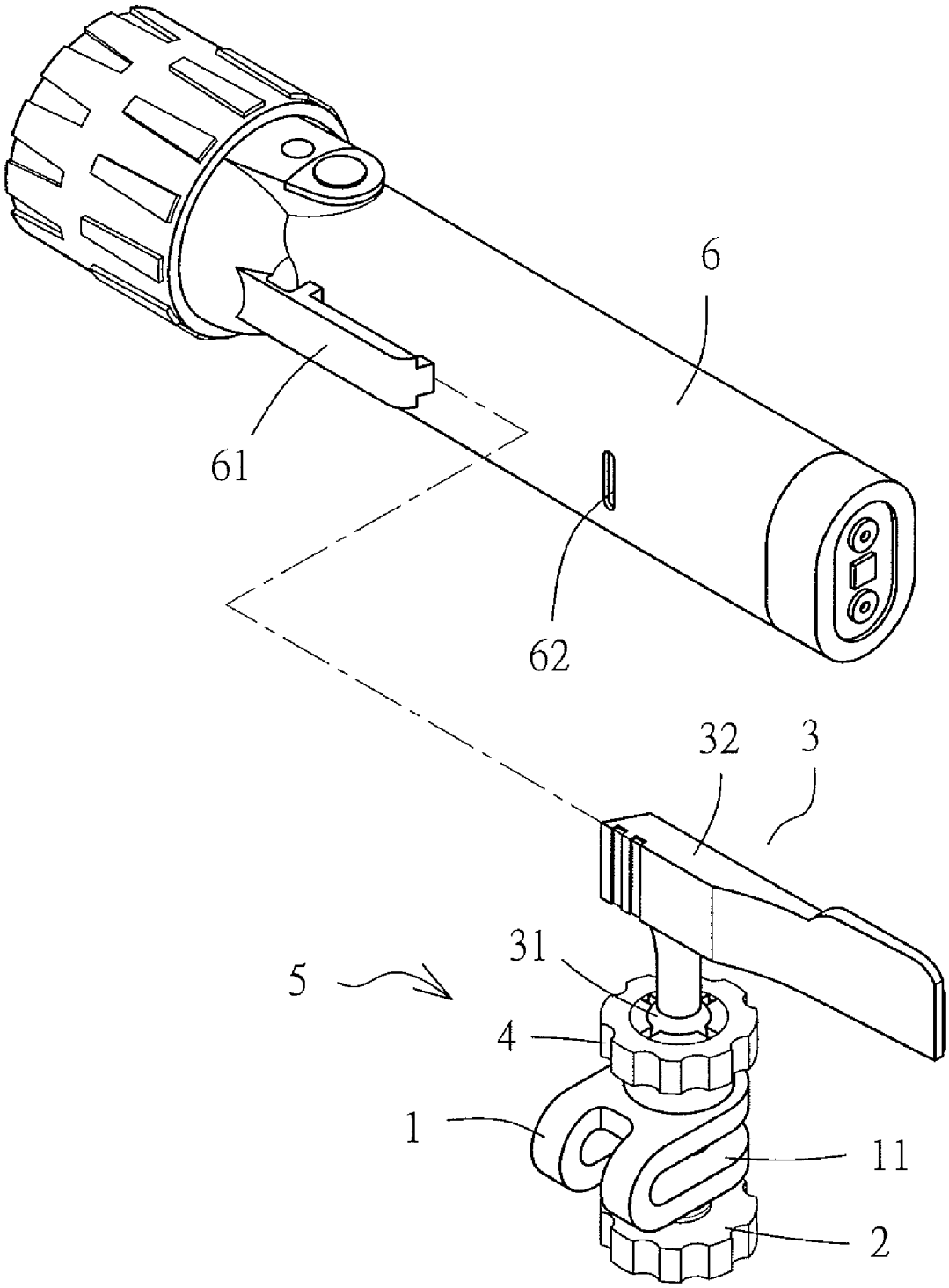
FIG. 5 is a perspective view showing the flashlight mount depicted in FIG. 1 and a flashlight having an elliptical cross-section that is to be fastened to the flashlight mount.
Figure 6:
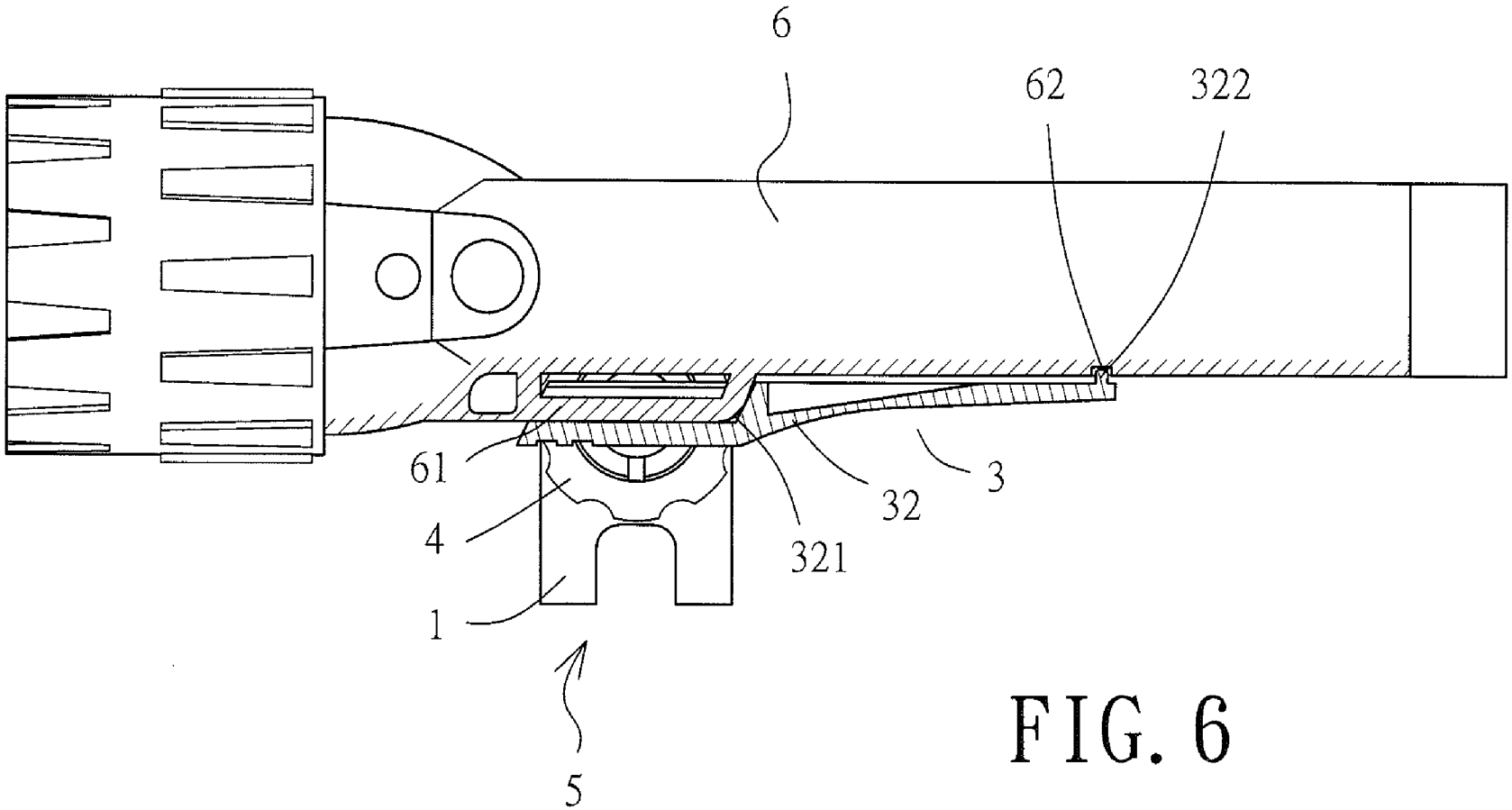
FIG. 6 is a top sectional view showing the flashlight mount depicted in FIG. 1 and the flashlight depicted in FIG. 5 in the assembled state.
Figure 7:
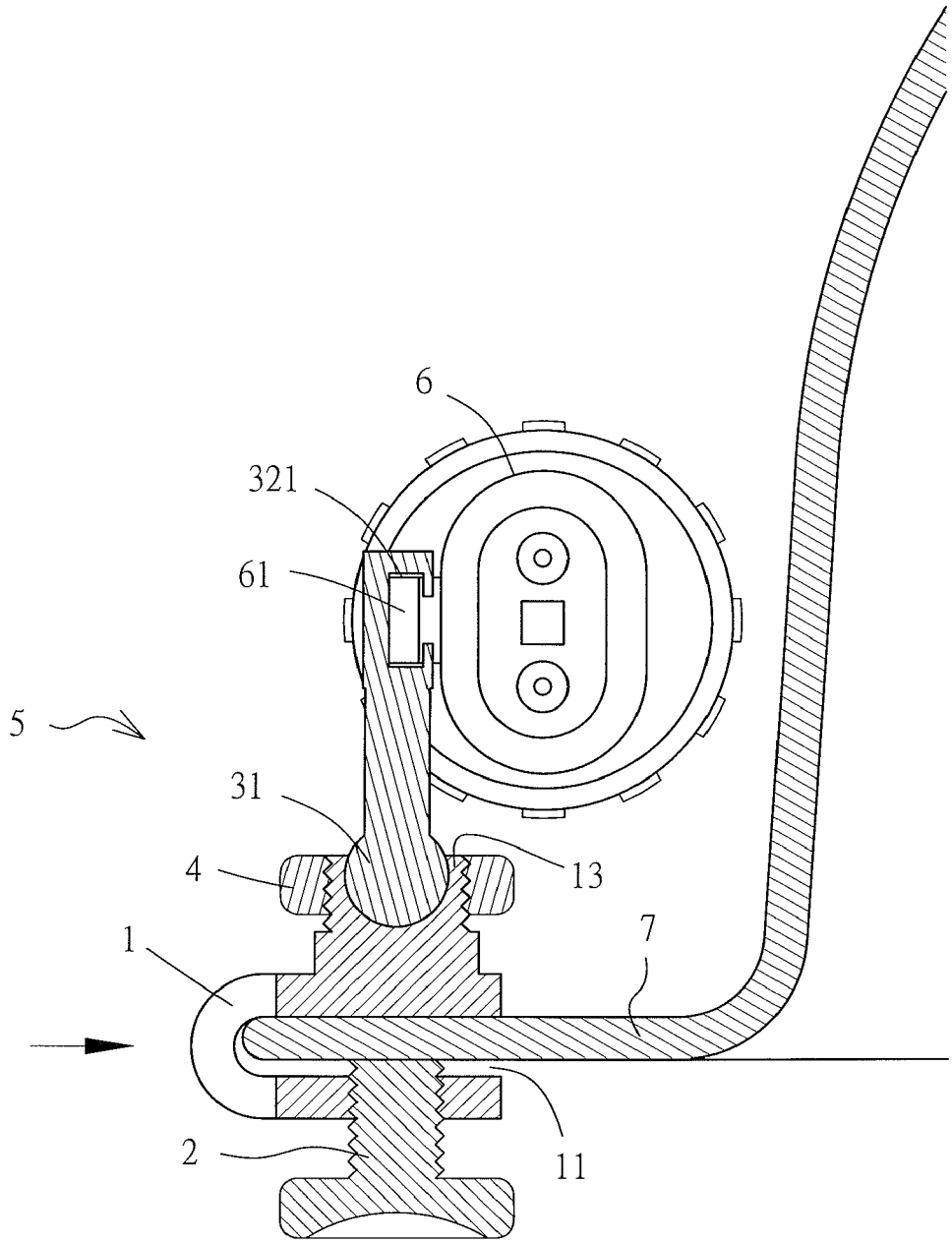
FIG. 7 is a front sectional view showing the flashlight mount depicted in FIG. 1 and the flashlight depicted in FIG. 5 in the assembled state.

Referring to FIG. 5, a flashlight 6 having an elliptical cross-section and an engaging section 61 is fastened to the mount 5 as follows. The engaging section 61 provided on a lateral side of the flashlight 6 is inserted into the C-shaped groove 321 formed on one side of the fastening extension 32, as can be seen more clearly in FIG. 7. Once the engaging section 61 is inserted in the C-shaped groove 321 to the greatest extent possible, a limiting recess 62 concavely provided at one end of the flashlight 6 is engaged with the projection 322 at the corresponding end of the fastening extension 32, as shown more clearly in FIG. 6, thereby fixing the flashlight 6 securely in position to the elongate clamping element 3. Following that, an object to which the mount 5 is to be clamped (exemplified herein by the edge 7 of a fireman's helmet) is inserted into the insertion space 11 extending laterally into the lower section of the clamp-type positioning element 1, as shown in FIG. 7, and the lower screw rod 2 is rotated upward to fasten the clamp-type positioning element 1 to the object in a clamping manner. Thus, the flashlight 6 not only can be flexibly installed but also allows angular adjustment to the desired lighting directions.

Figure 8:
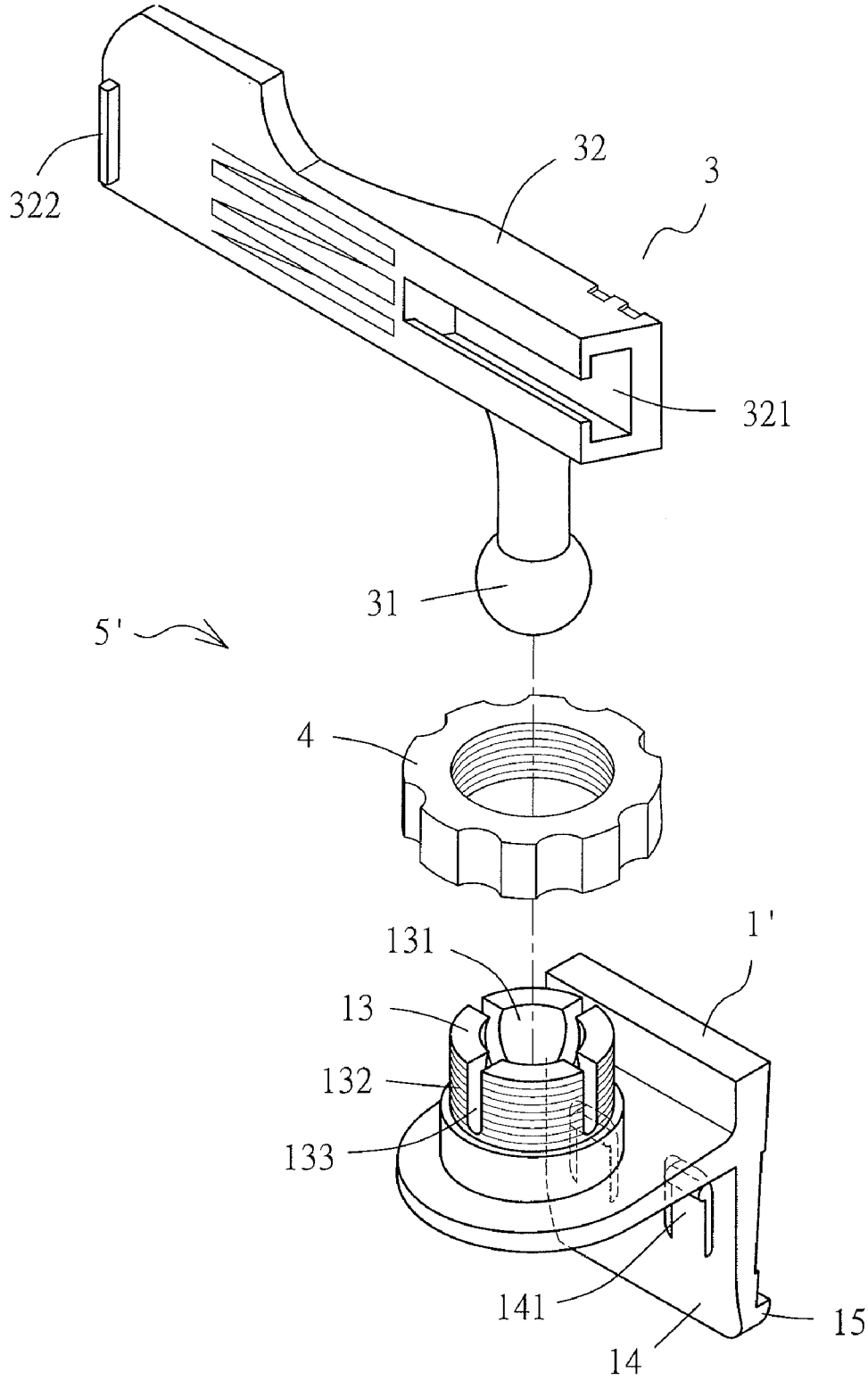
FIG. 8 is an exploded perspective view of a flashlight mount according to a second embodiment of the present invention.
Figure 9:
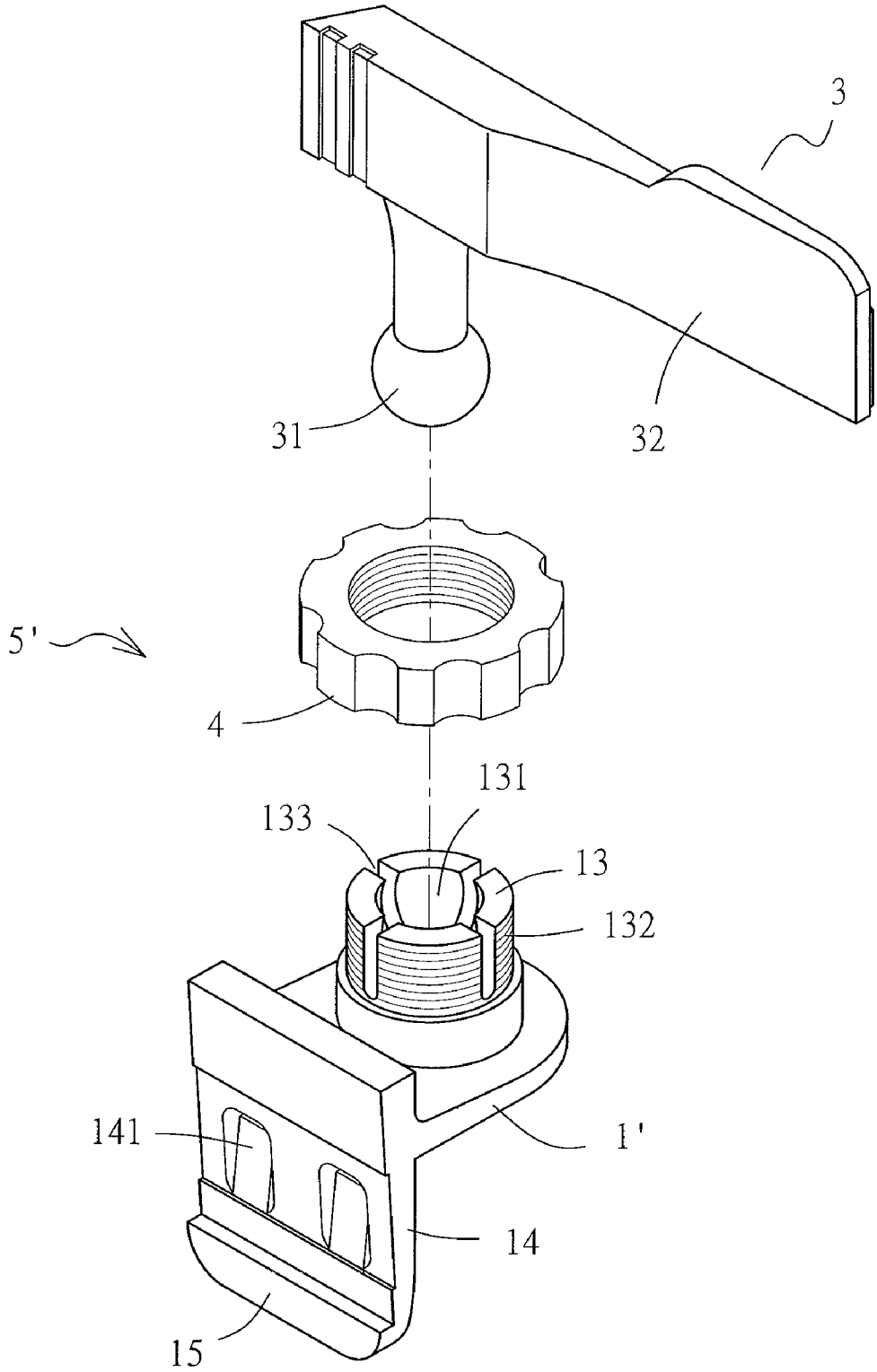
FIG. 9 is another exploded perspective view of the flashlight mount depicted in FIG. 8, when viewed from a different direction.

FIG. 8 and FIG. 9 show a flashlight mount 5' according to a second embodiment of the present invention, wherein the flashlight mount 5' includes an insertion-type positioning element 1', an elongate clamping element 3, and a screw nut 4. The elongate clamping element 3 and the screw nut 4 in the present embodiment have the same configurations as their counterparts in the mount 5 described above. The second embodiment is different from the first embodiment in the insertion-type positioning element 1'.

The insertion-type positioning element 1' has a lower section extended with an insertion part 14. The insertion part 14 has a surface formed with at least one resilient pressing portion 141. In addition, the lower end of the insertion part 14 is laterally extended with a hook 15. The insertion-type positioning element 1' further has an upper section formed as a receiving tube 13 having an inwardly extending ball-shaped space 131. The receiving tube 13 has an outer periphery formed with threads 132 and is circumferentially provided with a plurality of slots 133.

Figure 10:
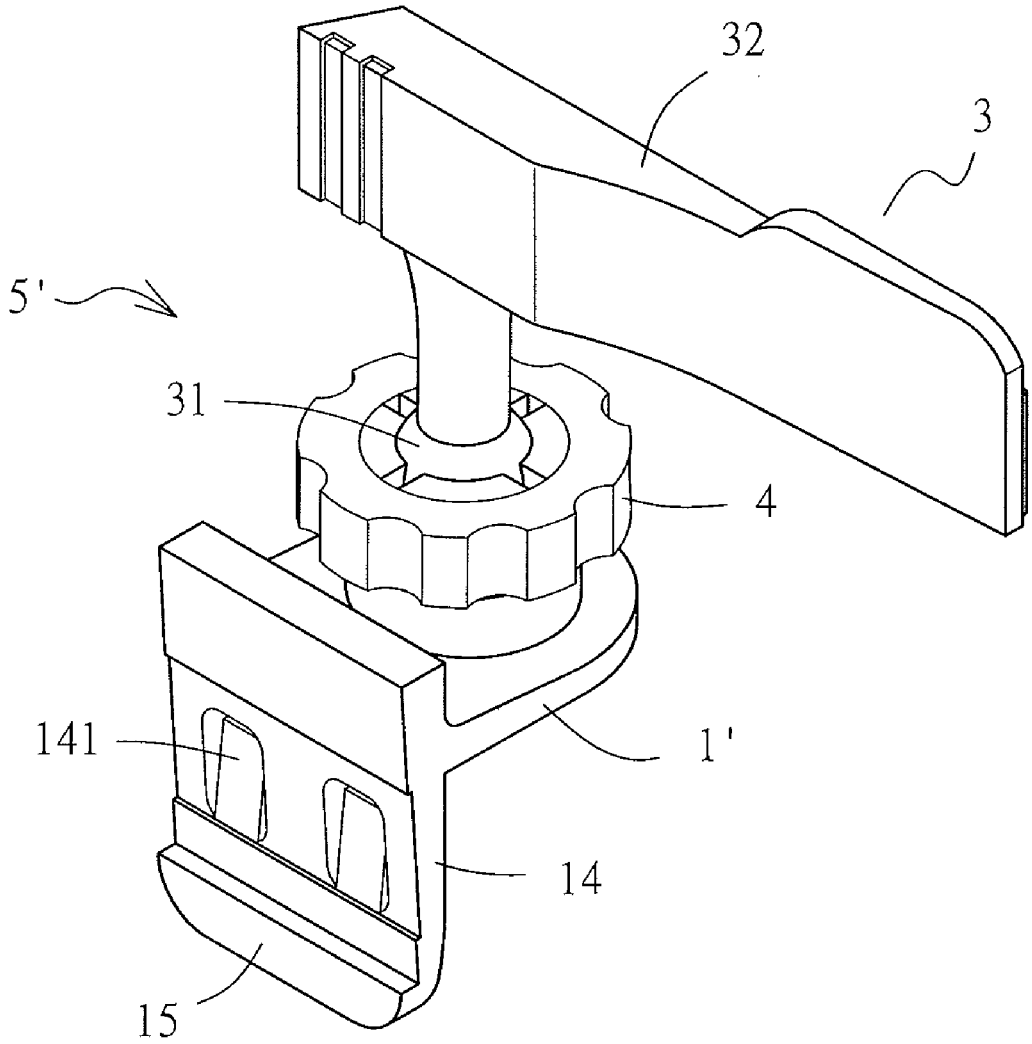
FIG. 10 is an assembled perspective view of the flashlight mount depicted in FIG. 8.
Figure 11:
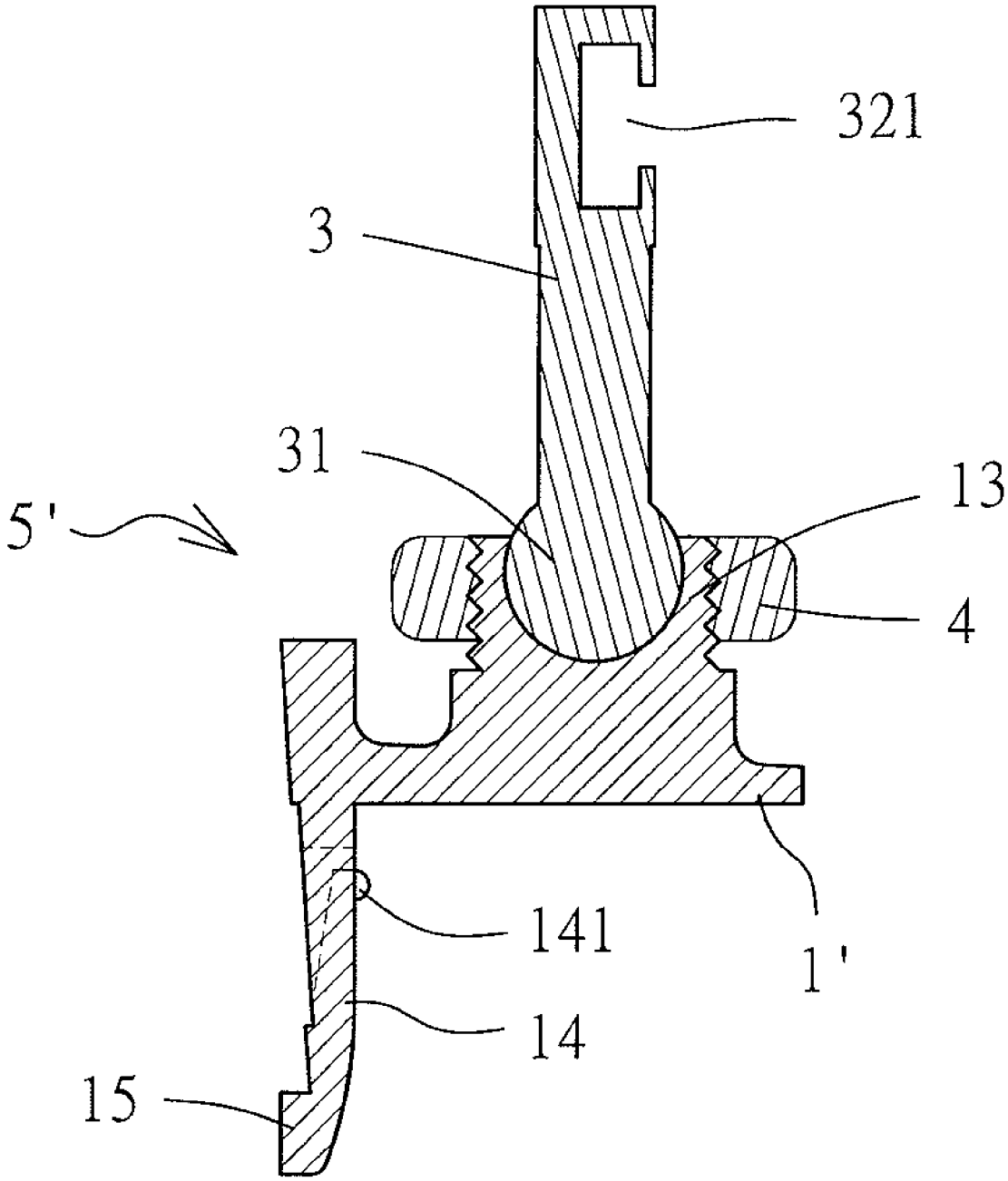
FIG. 11 is a front sectional view of the flashlight mount depicted in FIG. 8.

The insertion-type positioning element 1' and the elongate clamping element 3 are assembled in the following way. As shown in FIG. 10 and FIG. 11, the ball-shaped connecting portion 31 extending from the lower section of the elongate clamping element 3 is inserted into the ball-shaped space 131 formed in the upper section of the insertion-type positioning element 1'. Then, the screw nut 4, which has been mounted around the ball-shaped connecting portion 31 in advance, is screwed on the outer periphery of the receiving tube 13 such that the elongate clamping element 3 is pivotally connected to the insertion-type positioning element 1'. Thus, the assembly process of the mount 5' is completed.

Figure 12:
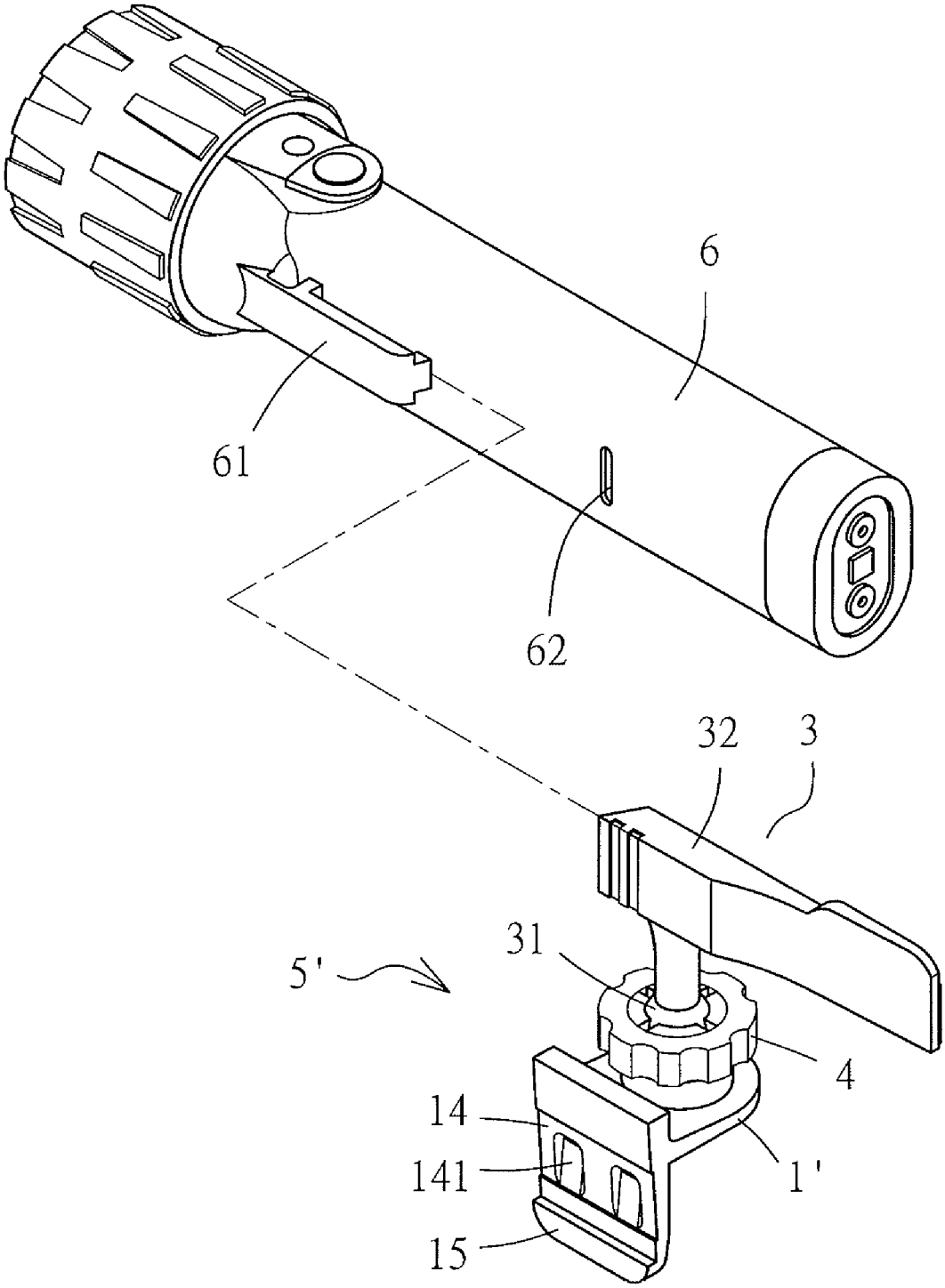
FIG. 12 a perspective view showing the flashlight mount depicted in FIG. 8 and a flashlight having an elliptical cross-section that is to be fastened to the flashlight mount.
Figure 13:
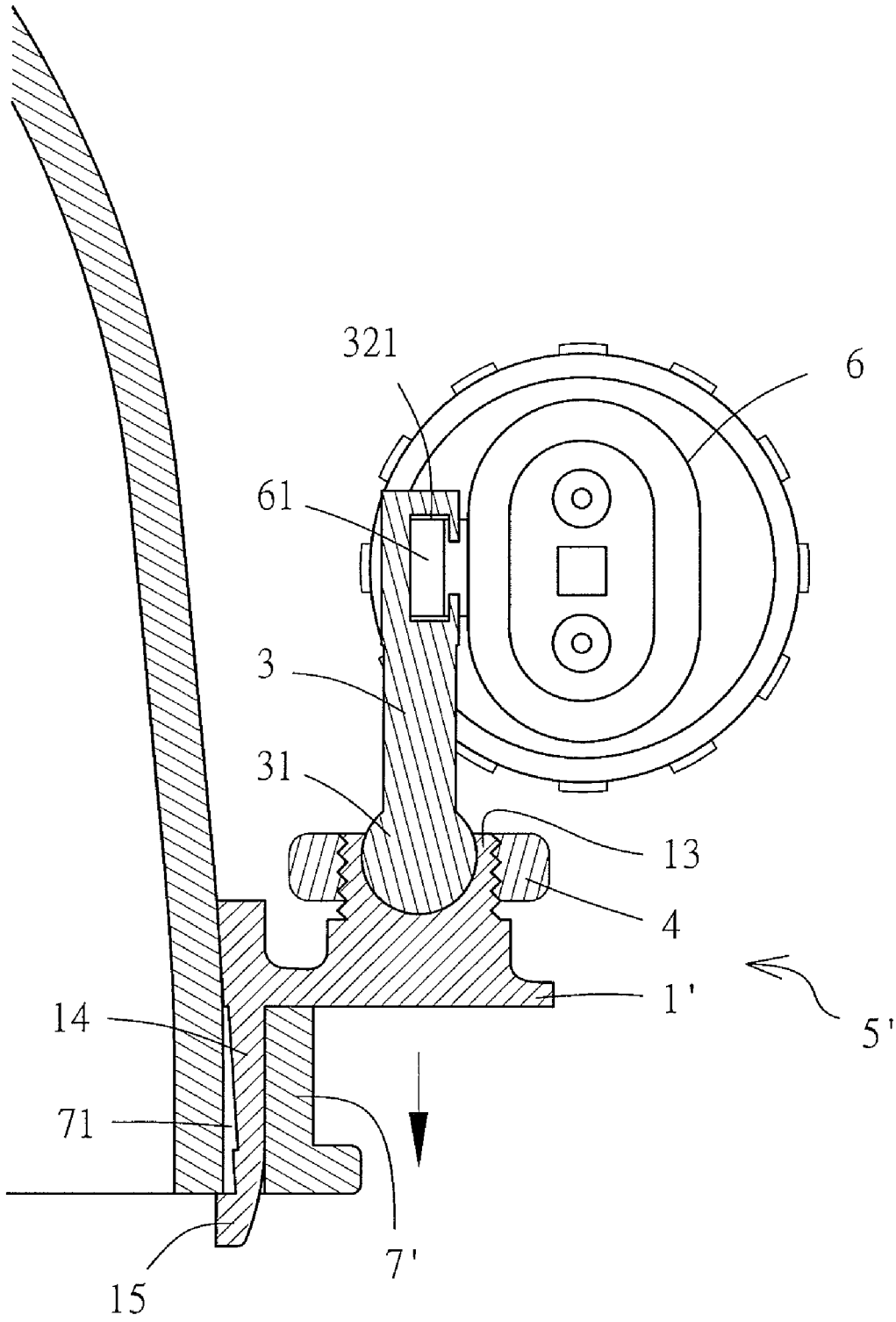
FIG. 13 is a front sectional view showing the flashlight mount depicted in FIG. 8 and the flashlight depicted in FIG. 12 in the assembled state.

Referring to FIG. 12 and FIG. 13, when it is desired to fasten a flashlight 6 having an elliptical cross-section and an engaging section 61 to the mount 5', the engaging section 61 on a lateral side of the flashlight 6 is inserted into the C-shaped groove 321 on one side of the fastening extension 32. When the engaging section 61 is inserted in the C-shaped groove 321 to the greatest extent possible, a limiting recess 62 concavely provided at one end of the flashlight 6 is engaged with the projection 322 at the corresponding end of the fastening extension 32 to fix the flashlight 6 securely in position to the elongate clamping element 3. Then, the insertion part 14 extending downward from the insertion-type positioning element 1' is inserted into a predetermined space 71 of an object to which the mount 5' is to be connected (exemplified herein by the edge 7' of a fireman's helmet whose form is different from that shown in the previous embodiment). As a result, the resilient pressing portions 141 on one surface of the insertion part 14 press against the wall of the predetermined space 71, and the hook 15 is engaged with a bottom portion of the object, thereby connecting the insertion-type positioning element 1' firmly to the object. Hence, the flashlight 6 not only can be flexibly installed but also can be angularly adjusted to the desired lighting directions.

What is claimed is:

1. A flashlight mount, comprising a clamp-type positioning element, a lower screw rod, an elongate clamping element, and a screw nut, the clamp-type positioning element having a lower section formed with an insertion space, the insertion space extending laterally into the lower section of the clamp-type positioning element, the clamp-type positioning element having a lower end which is adjacent to the insertion space and penetrated by a threaded hole in which the lower screw rod is screwed, the clamp-type positioning element having an upper section formed as a receiving tube, the receiving tube having an inwardly extending ball-shaped space and an outer periphery provided with threads, the receiving tube being circumferentially provided with a plurality of slots for allowing a ball-shaped connecting portion extending from a lower section of the elongate clamping element to be inserted into the receiving tube, the screw nut being mounted around the ball-shaped connecting portion and screwed on the outer periphery of the receiving tube such that the elongate clamping element is pivotally connected to the clamp-type positioning element, the elongate clamping element having an upper section formed as a horizontally extending fastening extension, there being a C-shaped groove concavely provided at an end of a lateral surface of the fastening extension and a projection formed at an opposite end of the lateral surface where the C-shaped groove is provided;

wherein a flashlight is fastened to the flashlight mount by: inserting an engaging section provided on a lateral side of the flashlight into the C-shaped groove laterally provided on the fastening extension such that, once the engaging section is inserted in the C-shaped groove to a greatest extent possible, a limiting recess concavely provided at an end of the flashlight is engaged with the projection at the opposite end of the fastening extension, thereby fixing the flashlight securely in position to the elongate clamping element; inserting an object to be clamped into the insertion space extending laterally into the lower section of the clamp-type positioning element; and rotating the lower screw rod upward to secure the clamp-type positioning element to the object in a clamping manner, thus allowing the flashlight to be flexibly installed and angularly adjusted to a desired lighting direction.

2. A flashlight mount, comprising an insertion-type positioning element, an elongate clamping element, and a screw nut, the insertion-type positioning element having a lower section extended with an insertion part, the insertion part having a surface formed with at least a resilient pressing portion, the insertion-type positioning element having an upper section formed as a receiving tube, the receiving tube having an inwardly extending ball-shaped space and an outer periphery provided with threads, the receiving tube being circumferentially provided with a plurality of slots for allowing a ball-shaped connecting portion extending from a lower section of the elongate clamping element to be inserted into the receiving tube, the screw nut being mounted around the ball-shaped connecting portion and screwed on the outer periphery of the receiving tube such that the elongate clamping element is pivotally connected to the insertion-type positioning element, the elongate clamping element having an upper section formed as a horizontally extending fastening extension, there being a C-shaped groove concavely provided at an end of a lateral surface of the fastening extension and a projection formed at an opposite end of the lateral surface where the C-shaped groove is provided;

wherein a flashlight is fastened to the flashlight mount by: inserting an engaging section provided on a lateral side of the flashlight into the C-shaped groove laterally provided on the fastening extension such that, once the engaging section is inserted in the C-shaped groove to a greatest extent possible, a limiting recess concavely provided at an end of the flashlight is engaged with the projection at the opposite end of the fastening extension, thereby fixing the flashlight securely in position to the elongate clamping element; and inserting the insertion part extending downward from the insertion-type positioning element into a predetermined space of an object to which the flashlight mount is to be connected, such that the at least a resilient pressing portion formed on the surface of the insertion part presses tightly against a wall of the predetermined space to fasten the insertion-type positioning element to the object, thus allowing the flashlight to be flexibly installed and angularly adjusted to a desired lighting direction.

3. The flashlight mount of claim 2, wherein the insertion part of the insertion-type positioning element has a lower end laterally extended with a hook, the hook being engaged with a bottom portion of the object after the insertion part is inserted into the predetermined space of the object, so as to fix the flashlight mount in position to the object.

* * * * *